US007896539B2

(12) United States Patent
Babaev

(10) Patent No.: US 7,896,539 B2
(45) Date of Patent: Mar. 1, 2011

(54) ULTRASOUND APPARATUS AND METHODS FOR MIXING LIQUIDS AND COATING STENTS

(75) Inventor: Eilaz P. Babaev, Minnetonka, MN (US)

(73) Assignee: Bacoustics, LLC, Minnetonka, MN (US)

( * ) Notice: Subject to any disclaimer, the term of this patent is extended or adjusted under 35 U.S.C. 154(b) by 1568 days.

(21) Appl. No.: 11/204,872

(22) Filed: Aug. 16, 2005

(65) Prior Publication Data

US 2007/0051307 A1 Mar. 8, 2007

(51) Int. Cl.
*B01F 11/00* (2006.01)
*B05B 1/08* (2006.01)

(52) U.S. Cl. ..... 366/108; 366/111; 366/127; 239/102.1

(58) Field of Classification Search ..... 366/108–128; 238/201.1

See application file for complete search history.

(56) References Cited

U.S. PATENT DOCUMENTS 3,334,818 A * 8/1967 Moen ..... 239/428.5
3,373,752 A * 3/1968 Kiyoshi ..... 134/1
3,400,892 A * 9/1968 Dale ..... 239/102.2
3,523,906 A 8/1970 Vrancken et al.
3,561,444 A 2/1971 Boucher
3,608,832 A * 9/1971 Hughes et al. ..... 239/419
3,663,288 A 5/1972 Miller
3,779,792 A 12/1973 Stoy et al.
3,970,250 A 7/1976 Drews
4,047,957 A 9/1977 De Winter et al.
4,100,309 A 7/1978 Micklus et al.
4,119,094 A 10/1978 Micklus et al.
4,263,188 A 4/1981 Hampton et al.
4,271,705 A 6/1981 Crostack
4,301,093 A 11/1981 Eck
4,301,968 A * 11/1981 Berger et al. ..... 239/102.2
4,306,816 A * 12/1981 Folland ..... 366/119
4,306,998 A 12/1981 Wenzel et al.
4,309,989 A 1/1982 Fahim
4,319,155 A 3/1982 Nakai et al.
4,373,009 A 2/1983 Winn
4,387,024 A 6/1983 Kurihara et al.
4,389,330 A 6/1983 Tice et al.
4,391,797 A 7/1983 Folkmam et al.
4,402,458 A 9/1983 Lierke et al.
4,459,317 A 7/1984 Lambert
4,487,808 A 12/1984 Lambert
4,492,622 A 1/1985 Kuypers
4,536,179 A 8/1985 Anderson et al.
4,541,564 A * 9/1985 Berger et al. ..... 239/102.2
4,548,844 A 10/1985 Podell et al.

(Continued)

*Primary Examiner*—Tony G Soohoo

(57) ABSTRACT

Ultrasound methods and apparatus for mixing two or more different liquids are disclosed. The ultrasound methods and apparatus may mix varied components including drugs, polymers, and coatings for application to a variety of medical apparatus surfaces. The apparatus and technique can generate a proper mixture which is uninterruptedly/continuously delivered to the surface of the medical apparatus. The apparatus may include specific ultrasound transducer/tip configurations which may allow for the mixing of different liquids in a mixing camera located inside of the vibrating tip. The apparatus and methods of the present invention may mix different drugs, applying them to stent surface using different effects like ultrasound cavitation and radiation forces. Furthermore, the disclosed methods and apparatus may generate a mixture and may deliver a targeted, gentle, highly controllable dispensation of continuous liquid spray which can reduce the loss of expensive pharmaceuticals.

11 Claims, 5 Drawing Sheets

U.S. PATENT DOCUMENTS

| | | | | |
|---|---|---|---|---|
| 4,582,654 | A | | 4/1986 | Karnicky et al. |
| 4,642,267 | A | | 2/1987 | Creasy et al. |
| 4,659,014 | A | * | 4/1987 | Soth et al. ..... 239/102.2 |
| 4,666,437 | A | | 5/1987 | Lambert |
| 4,675,361 | A | | 6/1987 | Ward, Jr. |
| 4,684,328 | A | | 8/1987 | Murphy |
| 4,692,352 | A | | 9/1987 | Huddleston |
| 4,705,709 | A | | 11/1987 | Vailancourt |
| 4,715,353 | A | | 12/1987 | Koike et al. |
| 4,721,117 | A | | 1/1988 | Mar et al. |
| 4,726,525 | A | | 2/1988 | Yonekawa et al. |
| 4,734,092 | A | | 3/1988 | Millerd |
| 4,748,986 | A | | 6/1988 | Morrison et al. |
| 4,768,507 | A | | 9/1988 | Fischell et al. |
| 4,770,664 | A | | 9/1988 | Gogolewski |
| 4,793,339 | A | | 12/1988 | Matsumoto et al. |
| 4,795,458 | A | | 1/1989 | Regan |
| 4,833,014 | A | | 5/1989 | Linder et al. |
| 4,834,124 | A | * | 5/1989 | Honda ..... 134/184 |
| 4,841,976 | A | | 6/1989 | Packard et al. |
| 4,850,534 | A | | 7/1989 | Takahashi et al. |
| 4,867,173 | A | | 9/1989 | Leoni et al. |
| 4,876,126 | A | | 10/1989 | Takemura et al. |
| 4,877,989 | A | | 10/1989 | Drews et al. |
| 4,884,579 | A | | 12/1989 | Engelson |
| 4,923,464 | A | | 5/1990 | Di Pisa, Jr. |
| 4,925,698 | A | | 5/1990 | Klausner et al. |
| 4,943,460 | A | | 7/1990 | Markle et al. |
| 4,959,074 | A | | 9/1990 | Halpern et al. |
| 4,964,409 | A | | 10/1990 | Tremulis |
| 4,969,890 | A | | 11/1990 | Sugita et al. |
| 4,980,231 | A | | 12/1990 | Baker et al. |
| 5,002,582 | A | | 3/1991 | Guire et al. |
| 5,007,928 | A | | 4/1991 | Okamura et al. |
| 5,008,363 | A | | 4/1991 | Mallon et al. |
| 5,017,383 | A | | 5/1991 | Ozawa et al. |
| 5,019,400 | A | | 5/1991 | Gombotz et al. |
| 5,020,724 | A | * | 6/1991 | Kiyono et al. ..... 239/102.2 |
| 5,026,607 | A | | 6/1991 | Kiezulas |
| 5,037,656 | A | | 8/1991 | Pitt et al. |
| 5,037,677 | A | | 8/1991 | Halpern et al. |
| 5,040,543 | A | | 8/1991 | Badera et al. |
| 5,049,403 | A | | 9/1991 | Larm et al. |
| 5,057,371 | A | | 10/1991 | Canty et al. |
| 5,066,705 | A | | 11/1991 | Wickert |
| 5,067,489 | A | | 11/1991 | Lind |
| 5,069,217 | A | | 12/1991 | Fleischhacker, Jr. |
| 5,069,226 | A | | 12/1991 | Yamauchi et al. |
| 5,076,266 | A | | 12/1991 | Babaev |
| 5,079,093 | A | | 1/1992 | Akashi et al. |
| 5,080,683 | A | | 1/1992 | Sulc et al. |
| 5,080,924 | A | | 1/1992 | Kamel et al. |
| 5,084,315 | A | | 1/1992 | Karimi et al. |
| 5,091,205 | A | | 2/1992 | Fan |
| 5,100,669 | A | | 3/1992 | Hyon et al. |
| 5,102,401 | A | | 4/1992 | Lambert et al. |
| 5,102,402 | A | | 4/1992 | Dror et al. |
| 5,102,417 | A | | 4/1992 | Palmaz |
| 5,105,010 | A | | 4/1992 | Sundaearaman et al. |
| 5,107,852 | A | | 4/1992 | Davidson et al. |
| 5,128,170 | A | | 7/1992 | Matsuda et al. |
| 5,134,993 | A | | 8/1992 | Van der Linden et al. |
| 5,147,370 | A | | 9/1992 | McNamara et al. |
| 5,160,790 | A | | 11/1992 | Elton |
| 5,202,066 | A | * | 4/1993 | Furusawa et al. ..... 264/444 |
| 5,211,183 | A | | 5/1993 | Wilson |
| 5,213,111 | A | | 5/1993 | Cook et al. |
| 5,217,026 | A | | 6/1993 | Stoy et al. |
| 5,234,457 | A | | 8/1993 | Andersen |
| 5,240,994 | A | | 8/1993 | Brink et al. |
| 5,241,970 | A | | 9/1993 | Johlin, Jr. et al. |
| 5,243,996 | A | | 9/1993 | Hall |
| 5,250,613 | A | | 10/1993 | Bergstrom et al. |
| 5,266,359 | A | | 11/1993 | Spielvogel |
| 5,275,173 | A | | 1/1994 | Samson et al. |
| 5,282,823 | A | | 2/1994 | Schwartz et al. |
| 5,283,063 | A | | 2/1994 | Freeman |
| 5,290,585 | A | | 3/1994 | Elton |
| 5,304,121 | A | | 4/1994 | Sahatjian |
| 5,304,140 | A | | 4/1994 | Kugo et al. |
| 5,315,998 | A | | 5/1994 | Tachibana et al. |
| 5,336,534 | A | | 8/1994 | Nakajima et al. |
| 5,344,426 | A | | 9/1994 | Lau et al. |
| 5,370,614 | A | | 12/1994 | Amundson et al. |
| 5,380,299 | A | | 1/1995 | Fearnot et al. |
| 5,389,379 | A | | 2/1995 | Dirix et al. |
| 5,419,760 | A | | 5/1995 | Narciso, Jr. |
| 5,423,885 | A | | 6/1995 | Williams |
| 5,443,458 | A | | 8/1995 | Eury |
| 5,443,496 | A | | 8/1995 | Schwartz et al. |
| 5,447,724 | A | | 9/1995 | Helmus et al. |
| 5,449,372 | A | | 9/1995 | Schmaltz et al. |
| 5,449,382 | A | | 9/1995 | Dayton |
| 5,464,650 | A | | 11/1995 | Berg et al. |
| 5,470,829 | A | | 11/1995 | Prisell et al. |
| 5,476,909 | A | | 12/1995 | Kim et al. |
| 5,512,055 | A | | 4/1996 | Domb et al. |
| 5,514,154 | A | | 5/1996 | Lau et al. |
| 5,515,841 | A | | 5/1996 | Robertson et al. |
| 5,515,842 | A | | 5/1996 | Ramseyer et al. |
| 5,527,337 | A | | 6/1996 | Stack et al. |
| 5,545,208 | A | | 8/1996 | Wolff et al. |
| 5,548,035 | A | | 8/1996 | Kim et al. |
| 5,551,416 | A | | 9/1996 | Stimpson et al. |
| 5,562,922 | A | | 10/1996 | Lambert |
| 5,569,463 | A | | 10/1996 | Helmus et al. |
| 5,576,072 | A | | 11/1996 | Hostettler et al. |
| 5,578,075 | A | | 11/1996 | Dayton |
| 5,591,227 | A | | 1/1997 | Dinh et al. |
| 5,597,292 | A | | 1/1997 | Rhee et al. |
| 5,605,696 | A | | 2/1997 | Eury et al. |
| 5,609,629 | A | | 3/1997 | Fearnot et al. |
| 5,616,608 | A | | 4/1997 | Kinsella et al. |
| 5,620,738 | A | | 4/1997 | Fan et al. |
| 5,624,411 | A | | 4/1997 | Tuch |
| 5,626,862 | A | | 5/1997 | Brem et al. |
| 5,637,113 | A | | 6/1997 | Tartaglia et al. |
| 5,656,036 | A | | 8/1997 | Palmaz |
| 5,674,192 | A | | 10/1997 | Sahatjian et al. |
| 5,674,241 | A | | 10/1997 | Bley et al. |
| 5,674,242 | A | | 10/1997 | Phan et al. |
| 5,679,400 | A | | 10/1997 | Tuch |
| 5,697,967 | A | | 12/1997 | Dinh et al. |
| 5,700,286 | A | | 12/1997 | Tartaglia et al. |
| 5,702,754 | A | | 12/1997 | Zhong |
| 5,709,874 | A | | 1/1998 | Hanson et al. |
| 5,712,326 | A | | 1/1998 | Jones et al. |
| 5,716,981 | A | | 2/1998 | Hunter et al. |
| 5,733,925 | A | | 3/1998 | Kunz et al. |
| 5,739,237 | A | | 4/1998 | Russell et al. |
| 5,755,769 | A | | 5/1998 | Richard et al. |
| 5,776,184 | A | | 7/1998 | Tuch |
| 5,785,972 | A | | 7/1998 | Tyler |
| 5,799,732 | A | | 9/1998 | Gonzalez et al. |
| 5,837,008 | A | | 11/1998 | Berg et al. |
| 5,902,332 | A | | 5/1999 | Schatz |
| 5,957,975 | A | | 9/1999 | Lafont et al. |
| 5,972,027 | A | | 10/1999 | Johnson |
| 6,041,253 | A | | 3/2000 | Kost et al. |
| 6,077,543 | A | | 6/2000 | Gordon et al. |
| 6,099,561 | A | | 8/2000 | Alt |
| 6,099,562 | A | | 8/2000 | Ding et al. |
| 6,099,563 | A | | 8/2000 | Zhong |
| 6,102,298 | A | | 8/2000 | Bush et al. |

6,104,952 A 8/2000 Tu et al.
6,120,536 A 9/2000 Ding et al.
6,190,315 B1 2/2001 Kost et al.
6,231,600 B1 5/2001 Zhong
6,234,765 B1 5/2001 Deak
6,234,990 B1 5/2001 Rowe et al.
6,251,099 B1 6/2001 Kollias et al.
6,258,121 B1 7/2001 Yang et al.
6,283,626 B1 * 9/2001 Lim et al. ..... 366/165.2
6,287,285 B1 9/2001 Michael et al.
6,296,630 B1 10/2001 Altman et al.
6,299,604 B1 10/2001 Ragheb et al.
6,306,166 B1 10/2001 Barry et al.
6,335,029 B1 1/2002 Kamath et al.
6,369,039 B1 4/2002 Palasis et al.
6,478,754 B1 11/2002 Babaev
6,569,099 B1 5/2003 Babaev
6,601,581 B1 8/2003 Babaev
6,623,444 B2 * 9/2003 Babaev ..... 604/22
6,663,554 B2 12/2003 Babaev
6,706,288 B2 3/2004 Gustavsson et al.
6,720,710 B1 4/2004 Wenzel et al.
6,723,064 B2 * 4/2004 Babaev ..... 604/22
6,730,349 B2 5/2004 Schwarz et al.
6,837,445 B1 1/2005 Tsai
6,861,088 B2 3/2005 Weber et al.
6,883,729 B2 4/2005 Putvinski et al.
7,060,319 B2 6/2006 Fredrickson
7,077,860 B2 7/2006 Yan et al.
2002/0127346 A1 9/2002 Heber
2003/0098364 A1 * 5/2003 Jameson ..... 239/102.2
2003/0223886 A1 12/2003 Keilman
2004/0022695 A1 * 2/2004 Simon et al. ..... 422/128
2004/0039375 A1 2/2004 Miyazawa
2004/0045547 A1 3/2004 Yamamoto et al.
2004/0191405 A1 9/2004 Kerrigan
2004/0197585 A1 10/2004 Hughes et al.
2004/0204680 A1 10/2004 Lal et al.
2004/0204750 A1 10/2004 Dinh
2004/0211362 A1 10/2004 Castro et al.
2004/0215313 A1 10/2004 Cheng
2004/0215336 A1 10/2004 Udipi et al.
2004/0220610 A1 11/2004 Kreidler et al.
2004/0224001 A1 11/2004 Pacetti et al.
2004/0234748 A1 11/2004 Stenzel
2004/0236399 A1 11/2004 Sundar
2004/0249449 A1 12/2004 Shanley et al.
2005/0043788 A1 2/2005 Luo et al.
2005/0058768 A1 3/2005 Teichman
2005/0064088 A1 3/2005 Fredrickson
2005/0070936 A1 3/2005 Pacetti
2005/0070997 A1 3/2005 Thornton et al.
2007/0051307 A1 * 3/2007 Babaev ..... 118/620
2007/0295832 A1 12/2007 Gibson et al.
2008/0006714 A1 1/2008 McNichols et al.
2008/0091108 A1 * 4/2008 Babaev ..... 600/462
2009/0014551 A1 * 1/2009 Babaev ..... 239/102.2
2009/0018492 A1 * 1/2009 Babaev ..... 604/24
2009/0200394 A1 * 8/2009 Babaev ..... 239/102.1
2009/0200396 A1 * 8/2009 Babaev ..... 239/102.2

* cited by examiner

ULTRASOUND APPARATUS AND METHODS FOR MIXING LIQUIDS AND COATING STENTS

BACKGROUND OF THE INVENTION

1. Field of the Invention

The present invention relates to the coatings for medical devices and, more particularly, to apparatus and methods using ultrasound energy for mixing two or more different liquids and coating any medical device surfaces. The term "medical device" as used in this application includes stents, catheters, synthetic blood vessels, artificial valves or other similar devices amenable and benefited from spray coating. For clarity, understandability and by way of example, the term "stent" in this application is used interchangeably with the term "medical device".

2. Background of the Related Art

A stent is a generally small, cylindrical shaped, mesh tube that is inserted permanently into an artery. A stent helps hold open an artery so that blood can flow through it. Stents can generally be divided into two categories: a) Metallic Bare Stents; and b) Drug Eluting Stents. Drug-eluting stent contain drugs that potentially reduce the chance the arteries will become blocked again.

The stents are generally tubular in design made up of fine mesh and/or wire having a small diameter and defining a large number of narrow spaces between various components. Frequently, stents are coated with a range of materials utilizing various methodologies and for various reasons. Because of their specific construction, designs and materials, uniformly coating the inner and outer surfaces of the stent, repeatably with no webbing, stringing and with controllable dosage of drug-polymer coating has been problematic.

Examples of patents disclosing stents include U.S. Pat. No. 4,739,762 by Palmaz; U.S. Pat. No. 5,133,732 by Wiktor; U.S. Pat. No. 5,292,331 by Boneau; U.S. Pat. No. 6,908,622 by Barry et al.; U.S. Pat. No. 6,908,624 Hossayniy et al.; and U.S. Pat. No. 6,913,617 by Reiss.

There are a variety of U.S. Published Patent Applications related to stent coatings, including, for example: U.S. Pat. Pub. No. 2003/0225451 A1 by Sundar; U.S. Pat. Pub. No. 2004/0215336 A1 by Udipi, et al.; U.S. Pat. Pub. No. 2004/0224001 A1 by Pacetti, et al.; U.S. Pat. Pub. No. 2004/0234748 A1 by Stenzel; U.S. Pat. Pub. No. 2004/0236399 A1 by Sundar; and U.S. Pat. Pub. No. 2004/0254638 A1 Byun.

According to above-mentioned patents and applications, the coating have been applied to the surface of stents from both inside and outside by different methods, such as mechanical coating, gas spray coating, dipping, polarized coating, electrical charge (electrostatic) coating, ultrasound coating, etc. Some of them like U.S. Pat. No. 6,656,506 utilize a combination of dipping and spraying). Several of them utilize the ultrasound energy, such as, for example, U.S. Pat. No. 6,767,637; and U.S. Pat. Pub. No. 2005/0064088 for ultrasound spraying. In another method, U.S. Pat. No. 5,891,507 discloses coating the surface of a stent by dipping in ultrasonic bath.

Despite these coating technologies and methods, these related technologies have numerous shortcomings and problems. For example, non-uniformity of coating thickness, webbing, stringing, bare spots on the stent surface, drug wasting, over spray, difficulties with control of drug flow volume, adhesive problems, long drying time and a need sterilization/sanitation, among others.

Ultrasonic sprayers (U.S. Pat. Nos. 4,153,201, 4,655,393, and 5,516,043) typically operate by passing liquid through the central orifice of the tip of an ultrasound instrument. Known applications include the use of a gas stream to deliver aerosol particles to coating surface. Prior art systems are being used for ultrasonic stent coating by delivering aerosol particles via air jet or gas stream.

Among prior gas ultrasound sprayers are wound treatment applications (U.S. Pat. Nos. 5,076,266; 6,478,754; 6,569,099; 6,601,581; 6,663,554), which are creating the spray. USSR patent #1237261, issued for Babaev in 1986 can mix the different liquids outside of the ultrasound transducer tip.

Typically, stents need to be coated with a drug and/or polymer in a single layer. Current techniques require the drug or polymer be mixed before coating. This can lead to timing issues such as when a polymer is polymerizes after mixing.

Accordingly, there is a need for a method and device for mixing two or more different drugs with the polymers and defect-free, controllable coating process of the stents.

SUMMARY OF THE INVENTION

According to the present invention, ultrasonic methods and apparatus for stent coating are described. The present ultrasonic method and apparatus may provide a proper mixing of two or more different liquids in a mixing chamber (camera) defined by an ultrasound transducer tip. The apparatus in accordance with the present invention may create the uniform, gentle and targeted spray for coating of the surface.

In one aspect, the present invention is directed to uninterruptedly mix different liquids and coat stents with controllable thickness of layer without webbing and stringing.

In another aspect, the present invention may provide an apparatus including a mixing chamber (camera) located inside of the ultrasound transducer tip. A controlled amount of different liquids from different reservoirs may be provided to the mixing chamber (camera) of the ultrasonic tip. The ultrasonic tip may be cylindrical, rectangular or otherwise shaped to create the proper mixture. The mixture created may be delivered to the distal end of the tip via a central orifice to create a fine spray.

Liquid may be controllably delivered into the mixing chamber using precise syringe pumps through capillary and/or gravitational action. When using syringe pumps, the amount of liquid delivered may be approximately the same volume or weight of the coating layer.

A method of the present invention for coating medical devices including stents can create a desired mixture inside of an ultrasonic tip from different liquids, drugs, polymers, among other materials and can provide uninterruptedly sprays to the surface.

Methods in accordance with the present invention may also use a number of acoustic effects of low frequency ultrasonic waves, such as cavitation, micro streaming, and standing waves inside of the mixing chamber in the ultrasonic tip, which are not typically utilized in liquid mixing or coating technologies.

The method may include spinning of the stent and moving of the ultrasound mixing and coating head during the coating process to create special ultrasonic-acoustic effects, which will be describe in details below. All coating operations run with special software programs to achieve the high quality results.

The method and apparatus can mix different liquids such as drugs, polymers, etc., and coat rigid, flexible, self expanded stents made by different materials.

A method also may include directing the further gas flow onto the mixing and coating area. The gas flow may be hot or cold and directed through the mixing chamber and/or spray within particles or separately.

The device part of the invention consists of specific construction of ultrasonic tips, which allows mixing of different liquids to uninterruptedly create the spray.

The ultrasound frequency may be between 20 KHz and 20 MHz or more. Preferable frequency is 20 KHz to 200 KHz, recommended frequency is 30 KHz. The rate of ultrasound waves amplitude may be between 2 micron and 300 micron or more. Thereby, there is provided a method and device for uninterruptedly ultrasound stent coating with proper mixing of different liquids with no webbing and stringing.

One aspect of this invention may be to provide a method and device for mixing two ore more different liquids.

Another aspect of the invention may be to provide a method and device for mixing two or more unmixable liquids.

Another aspect of the invention may be to provide an improved method and device for mixing two ore more different drugs, polymers, or drug with the polymer for coating of medical implants such as a stents.

Another aspect of this invention may be to provide a method and device for mixing two or more different liquids, such a drugs, polymers or a combination of drugs with the polymer and coating of stents using ultrasound.

Another aspect of this invention may be to provide a method and device for mixing two or more different drugs with the polymers, that provides controllable thickness of coating layer.

Another aspect of the invention may be to provide a method and device for simultaneous mixing of different liquids, creation of continuous, uniformed, directed spray for the proper mixture coating of stents.

Another aspect of the invention may be to provide a method and device for simultaneous mixing of different liquids, creation of continuous, uniformed, directed spray from proper mixture coating of stents, that avoids the coating defects like webbing, stringing, etc.

Another aspect of the invention may be to provide a method and device for simultaneous mixing of different liquids, creation of continuous, uniformed, directed spray for the proper mixture coating of stents, which increases the adhesivity property of stents without the use of chemicals. Another aspect of the invention may be to provide method and device for simultaneous mixing of different liquids, creation of continuous, uniformed, directed spray from proper mixture coating of stents that provides drying of the coating layer along the longitudinal axis of the structure simultaneously with the coating process.

Another aspect of the invention may be to provide a method and device for simultaneous mixing of different liquids, creation of continuous, uniform, directed spray from a proper mixture of a stent coating, that provides sterilization of the coating layer along the longitudinal axis of the structure simultaneously with the coating process.

Another aspect of invention may be to provide a method and device for creation of uninterrupted process of proper mixing two or more different liquids, creating the spray and coating the surface.

These and other aspects of the invention will become more apparent from the written description and figures below.

BRIEF DESCRIPTION OF THE DRAWINGS

The present invention will be shown and described with reference to the drawings.

DETAILED DESCRIPTION OF THE INVENTION

Figures 1, 2:
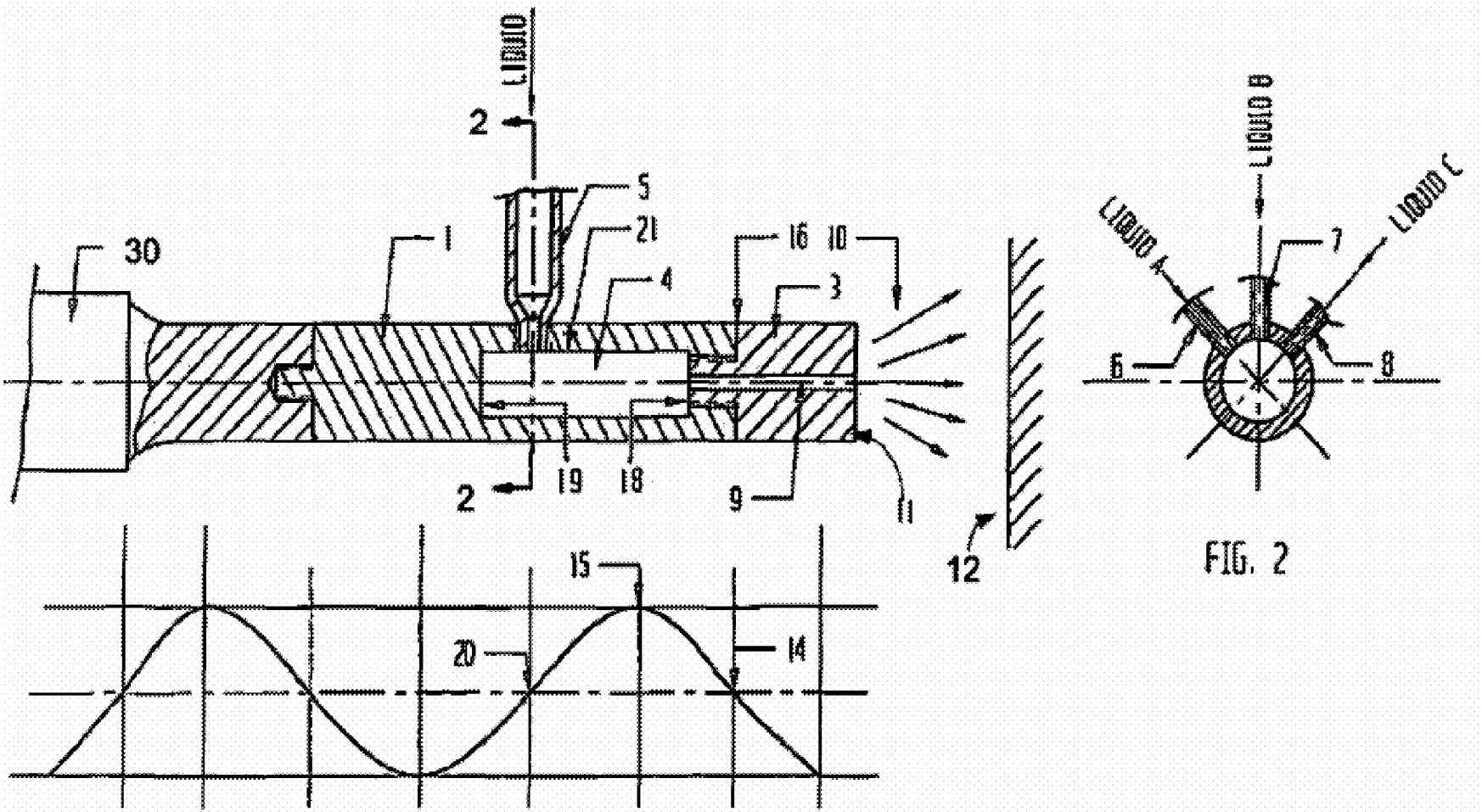
FIG. 1 is a cross sectional view of an embodiment of an ultrasonic mixing apparatus in use with the spray according to the present invention.
FIG. 2 illustrates a cross section of an embodiment of the apparatus with the delivery of liquid directly to mixing camera inside of ultrasonic tip according to the present invention. Liquid delivery tubes are located on one platan, perpendicular to the longitudinal axis of the tip.
Figure 3:
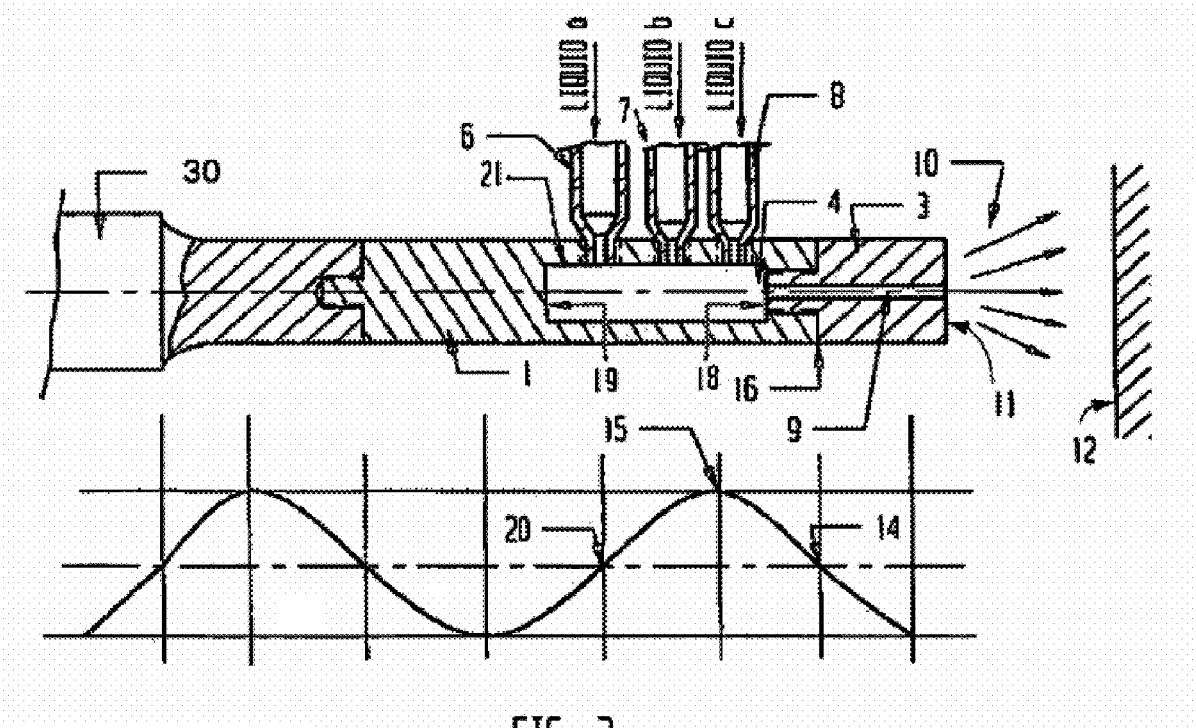
FIG. 3 illustrates the cross section of an embodiment of an apparatus with the delivery of liquid directly to mixing camera inside of ultrasonic tip according to the present invention. Liquid delivery tubes are located on the platan, along ultrasonic tip's longitudinal axis.
Figure 4:
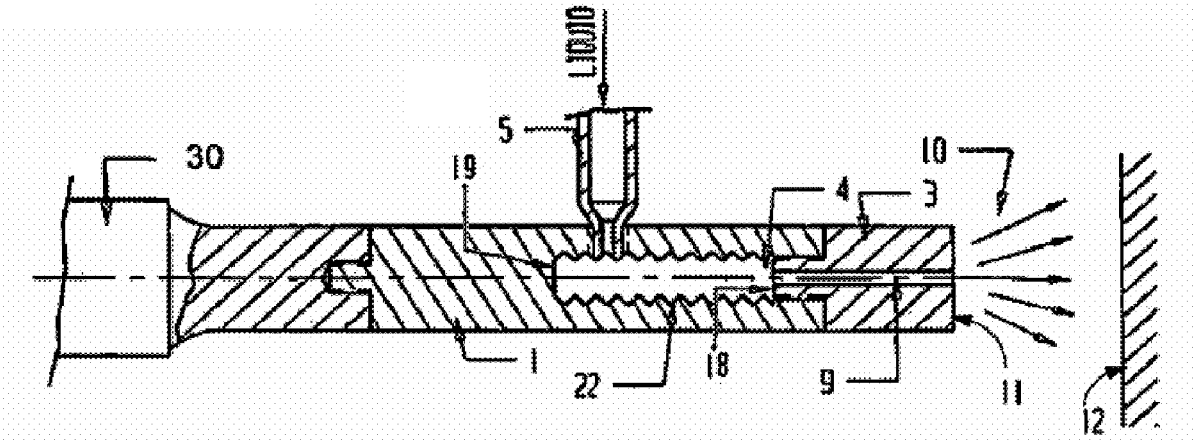
FIG. 4 is an illustration of cross section of an embodiment of an apparatus with the threaded mixing camera inside of ultrasonic tip according to the present invention.

The present invention provides an apparatus including an ultrasonic tip I defining a mixing chamber (camera) 4. Preferred embodiments of the present invention in the context of a method and apparatus are illustrated throughout the figures. Those skilled in the art will immediately understand the advantages for mixing of two or more different liquids such as a drugs and/or polymers and uninterruptedly coating the stent that will be provided by the present inventions upon review of the disclosure.

The ultrasonic tip 1 uses ultrasonic energy provided by an ultrasound transducer 30 to mix materials and coat medical apparatus. The methods are particularly useful when applied to coating stents and other devices having intricate details and complex shapes. Ultrasonic tips 1 in accordance with the present invention can provide highly controllable precise mixing of two or more drugs and polymers. The fine, targeted spray allows the coating of stents without substantial webbing, stringing and wasting the expensive drug through improved mixing. The present invention provides a novel ultrasonic tip 1 and method for mixing two or more different fluid to coat a stent. Embodiments of ultrasonic tip 1 in accordance with the present invention are illustrated in FIGS. 1 to 7. According to present invention, ultrasonic tip 1 includes a mixing chamber/camera 4 inside of the ultrasonic tip 1.

The mixing chamber 4 provides an ultrasonically active space for mixing of different liquids under acoustic forces including cavitation phenomena which can occur inside of chamber 4. Typically, chamber 4 is comprised of a cylindrically shaped radial wall 21 about the longitudinal axis of the ultrasonic tip 1. Typically, this cavitation phenomenon occurs between distal wall 18 and proximal wall 19 of the chamber perpendicular to the longitudinal axis. One or more syringe pumps (not shown) may be provided for delivery of different liquids into chamber 4 through tubes 5, 6, 7, 8, (FIG. 2), located on the platan perpendicular to longitudinal axis. Liquid delivery tubes 6, 7, 8 located along the longitudinal axis (FIG. 3) is also one of the embodiments of the present invention. Mixtures of drugs and/or polymers may be delivered in an uninterrupted fashion to a radiation surface 11 of tip 1 through an orifice 9 for creation of spray 10 and delivery to coating surface/stent 12. The diameter of orifice 9 preferably should be less than the diameter of the mixing chamber. To simplify manufacture, ultrasonic transducer tip 1 may include a distal end part 3 which is attached via threads on planar 16 to form the chamber 4. Distal end part 3 may be provided with a different diameter of central orifice 9 to create the spray 10 in the needed particle size. To avoid the loss of distal end part 3 it should be attached to tip 1 preferably on amplitudes node point 14. Liquid delivery tubes (5, 6, 7, and 8) should also be attached to tip 1 preferably on amplitudes node point 20. To achieve a high quality mixture, mixing cameras center can match or be near to the amplitudes anti node point 15.

It is important to note that a gas stream with a different temperature can be delivered into mixing chamber/camera 4 through one of the tubes (5, 6, 7, 8) to improve liquid mixing and spray coating process. This can change the spray volume, spray quality and may expedite the drying process.

When different liquids (a, b, c) are provided into activated mixing chamber 4, distal wall 19 under ultrasound radiation force delivers liquid drops flow forward. Retrograded or ricocheted liquid from proximal wall 18 encounters incoming liquid flow and creates the proper mixture from the ultrasound radiation/pressure forces and cavitation.

After the mixing chamber fills with the fluid, the ultrasound pressure forces the mixture through central orifice 9 to create spray 10 which is delivered to radiation surface 11. As the liquids are delivered and the tip vibrates, the mixing and spray coating process are occurring uninterruptedly.

Figure 5:
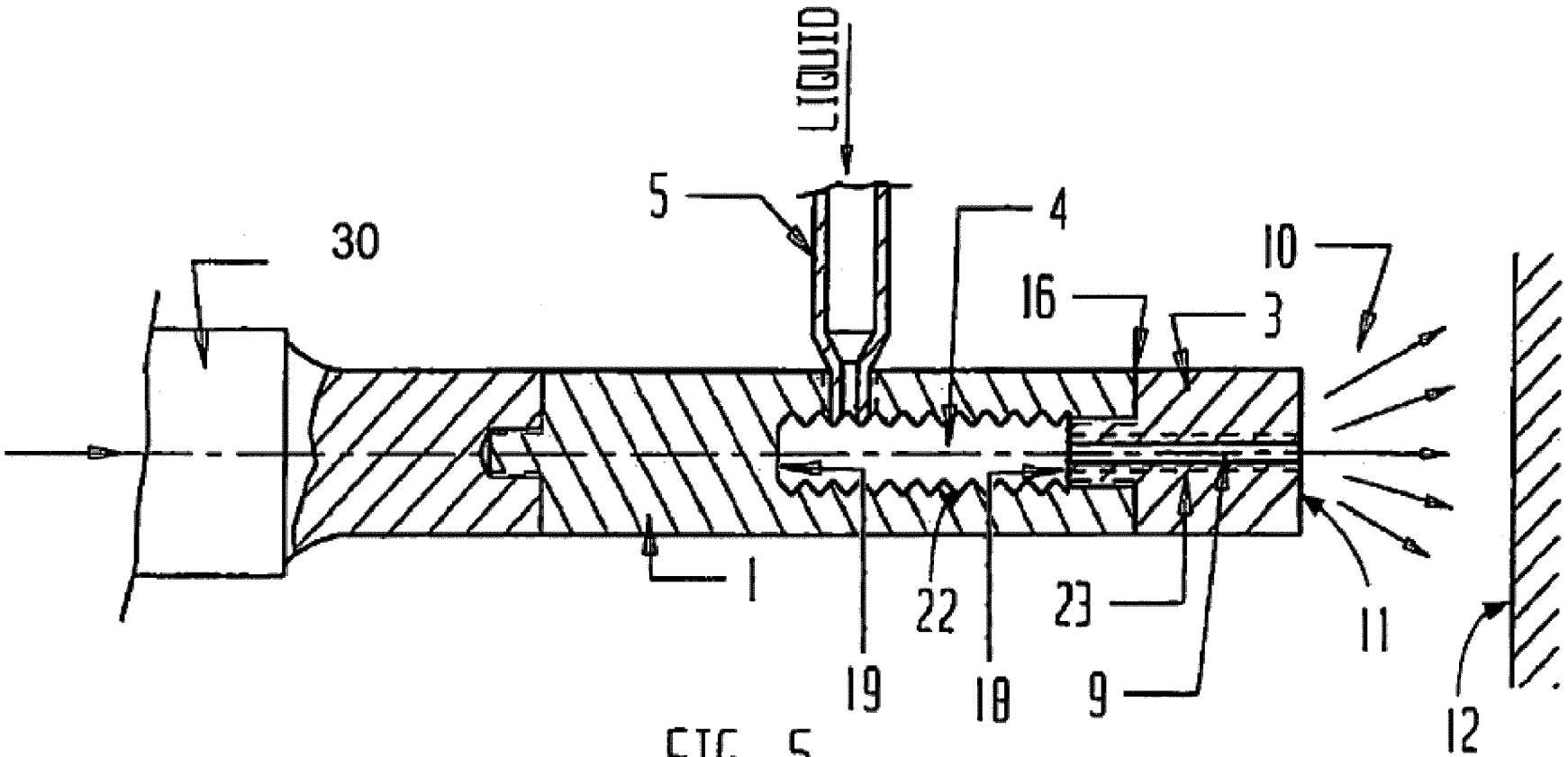
FIG. 5 illustrates a cross section of an embodiment of the apparatus with the delivery of one liquid to mixing camera through a central orifice of ultrasound transducer, and another liquid through the tube, perpendicular to ultrasonic tip's axis according to the present invention.

In one aspect of the present invention, for more effective and proper mixing process, mixing chamber 4 consists of at least one thread 22, groove ring or a waved shape (See FIG. 5). In this case the tooth of the tread acts as a mixing blade or spoon, forcing the different liquids to be mixed with the ultrasonic energy. The distal end orifice 9 also can be threaded 23 to provide a better mixing process.

Figure 6A:
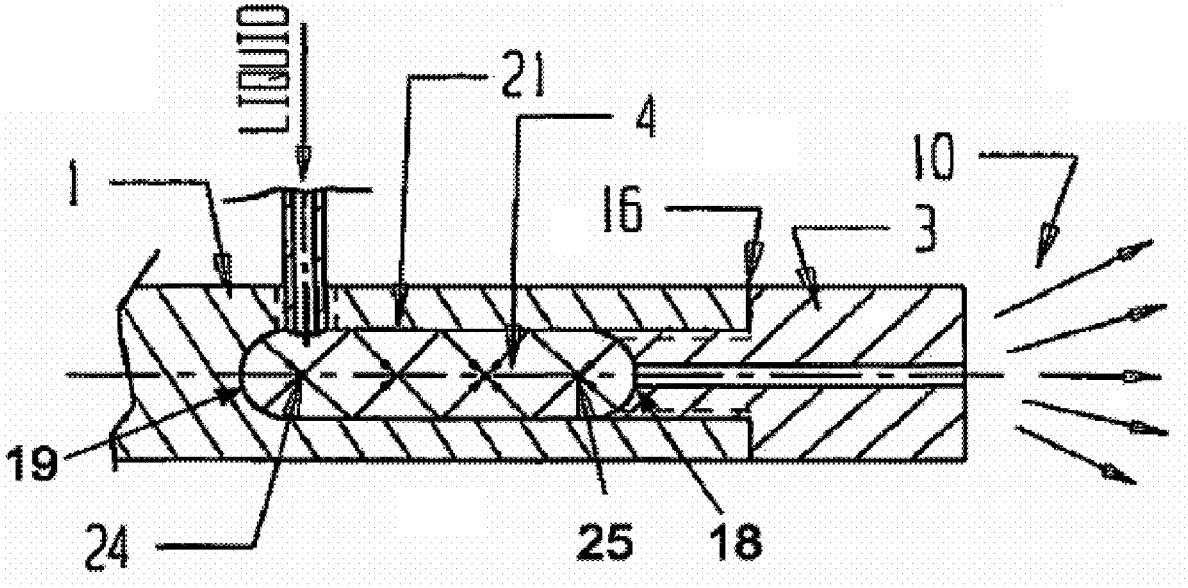
FIGS. 6A and 6B illustrate embodiments of the mixing chambers in expanded cross section having rounded radiation walls.
Figure 6B:
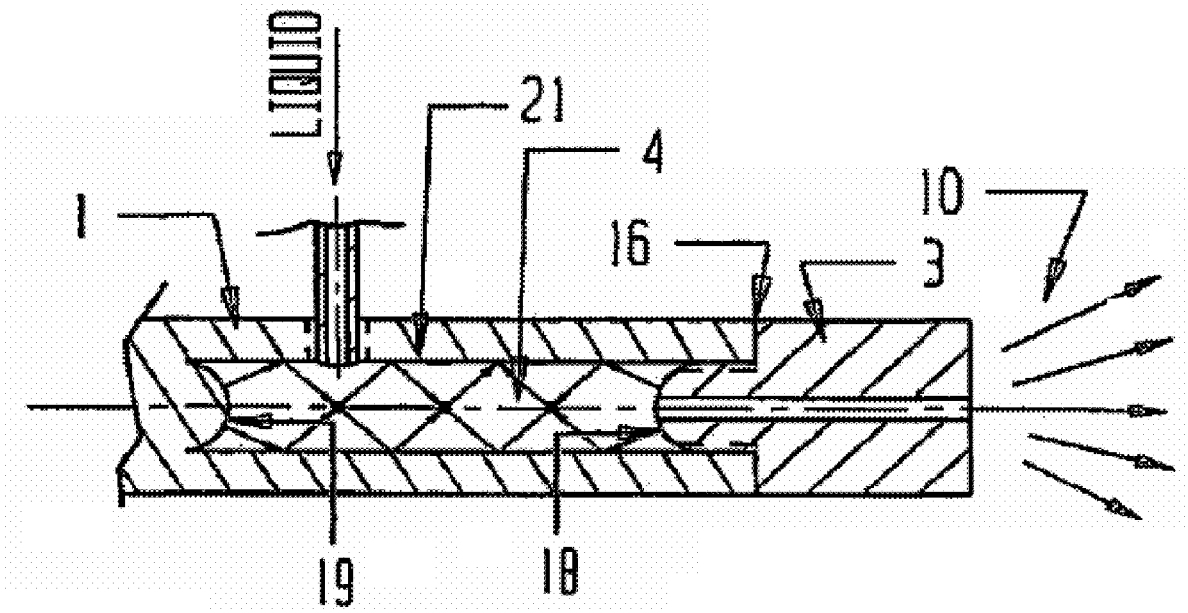
Figure 7:
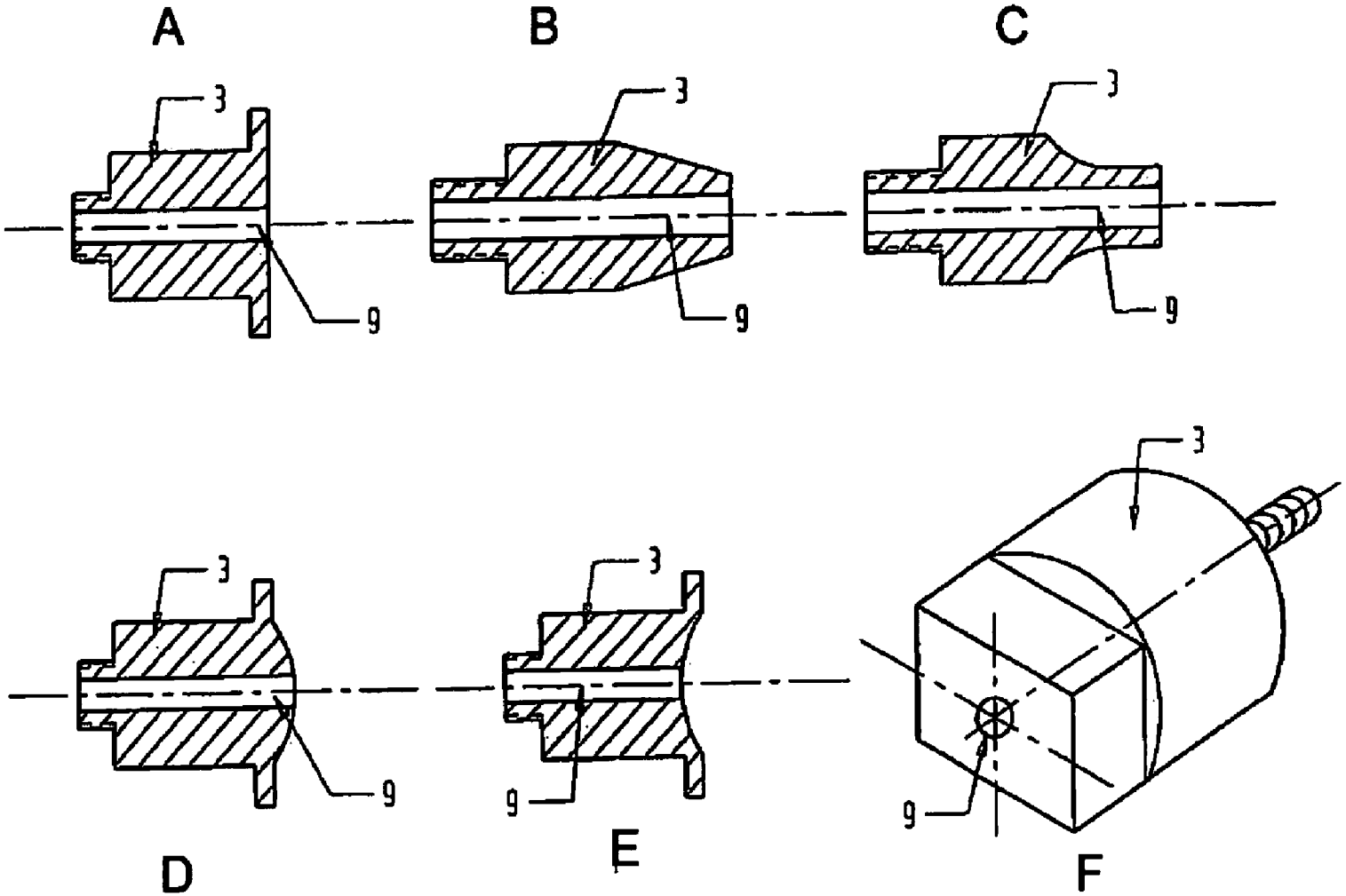
FIG. 7 illustrates embodiments of ultrasonic tips which are A) expanded flat, B) conical shape, C) exponential D) outside rounded, E) inside rounded-focused, and F) rectangular distal end configurations.

In another aspect (See FIG. 6), for a more effective and proper mixing process, mixing chambers distal wall 18 and proximal wall 19 can be rounded inside (See FIG. 6A) to create focused ultrasonic effect, which is much more powerful than the unfocused alternative. FIG. 6A shows the proximal focus point 24 and the distal focus point 25. The chamber walls also can be convex (See FIG. 6B) for the creation of a powerful cavitation effect to achieve an improved mixing process. In this case ultrasound waves being reflected from radial cylindrical walls of the mixing camera force the different liquid particles toward each other. This provides improved mixing of different liquids under ultrasound cavitation and radiation pressure.

FIGS. 7A-E provides an illustration of ultrasonic tip embodiments A) expanded flat, B) conical shape, C) exponential, D) outside rounded, E) inside rounded-focused and F) rectangular distal end configurations. These configurations allow control of the spray angle and coating quality depending on the coating requirements.

What is claimed is:

1. An apparatus for mixing comprising:

a. an ultrasound transducer having an ultrasonic horn;

b. the ultrasonic horn having a central axis and a distal end;

c. the ultrasonic horn also having a mixing chamber inside the ultrasonic horn having i. a proximal wall, ii. a distal wall, iii. at least one radial wall and iv. a rounded ultrasonic lens within the distal wall of the chamber;

d. at least one tube to deliver a fluid to the mixing chamber; and e. the ultrasonic horn having an orifice at the distal end for discharging the fluid.

2. The apparatus of claim 1 in which the orifice for discharging the fluid has at least one thread.

3. The apparatus of claim 1 in which the tube is attached to the ultrasound horn approximately on a node point.

4. The apparatus of claim 1 in which the distal end of the horn has a geometric confirmation selected from the group consisting of convex, concave, tapered or flat.

5. The apparatus of claim 1 in which the proximal wall is flat.

6. The apparatus of claim 1 in which the proximal wall is convex.

7. The apparatus of claim 1 in which the distal wall is convex.

8. The apparatus of claim 1 in which the proximal wall is concave.

9. The apparatus of claim 1 in which the distal wall is concave.

10. The apparatus of claim 1 further comprising a gas supply in communication with the tube to deliver fluid into the chamber.

11. The apparatus of claim 1 further comprising a supply of heated fluid in communication with the tube to deliver fluid into the chamber.

* * * * *